United States Patent [19]

Wilmeth et al.

[11] 4,091,890

[45] May 30, 1978

[54] VERY HIGH TORQUE RATCHET WRENCH

[75] Inventors: Claude H. Wilmeth; Fred H. Morton, both of Houston, Tex.

[73] Assignee: N-S-W Corporation, Houston, Tex.

[21] Appl. No.: 723,861

[22] Filed: Sep. 16, 1976

Related U.S. Application Data

[63] Continuation-in-part of Ser. No. 619,116, Oct. 2, 1975, abandoned.

[51] Int. Cl.[2] ..... B25B 29/00

[52] U.S. Cl. ..... 81/57.39

[58] Field of Search ..... 81/57.39, 61-63; 74/577 R, 577 M

[56] References Cited

U.S. PATENT DOCUMENTS

| | | | |
|---|---|---|---|
| 842,039 | 1/1907 | Walt | 81/62 |
| 3,930,776 | 1/1976 | Keller | 81/57.39 |
| 3,967,514 | 7/1976 | Deutch | 81/63 |

FOREIGN PATENT DOCUMENTS

| | | | |
|---|---|---|---|
| 1,191,282 | 4/1959 | France | 81/60 |

*Primary Examiner*—James L. Jones, Jr.
*Attorney, Agent, or Firm*—Michael P. Breston

[57] ABSTRACT

The high-torque ratchet wrench comprises two parallel side plates. Each plate has at one end thereof a bore. An annular ratchet wheel and a cooperating pawl are operatively disposed between the plates. The ratchet wheel defines a socket and carries a plurality of angularly-spaced teeth. A hub laterally extends from each side of the wheel. The hubs are rotatably mounted in the bores of the plates. The pawl has a head end portion which is pivotable about a pivot axis. A pivot pin including the pivot axis transversely extends between the plates for pivotally mounting the pawl between the plates. A pawl arm extends radially from the pivot pin relative to the wheel. The free end of the pawl is formed with a laterally extending segment relative to the wheel. The pawl segment has teeth on its side edge adapted to mesh with the ratchet wheel teeth. The pawl segment is adapted to receive from the pawl arm a radial force, which urges the pawl teeth to engage with the ratchet wheel teeth, and a tangential force which rotates the ratchet wheel.

5 Claims, 6 Drawing Figures

FIG. 3.
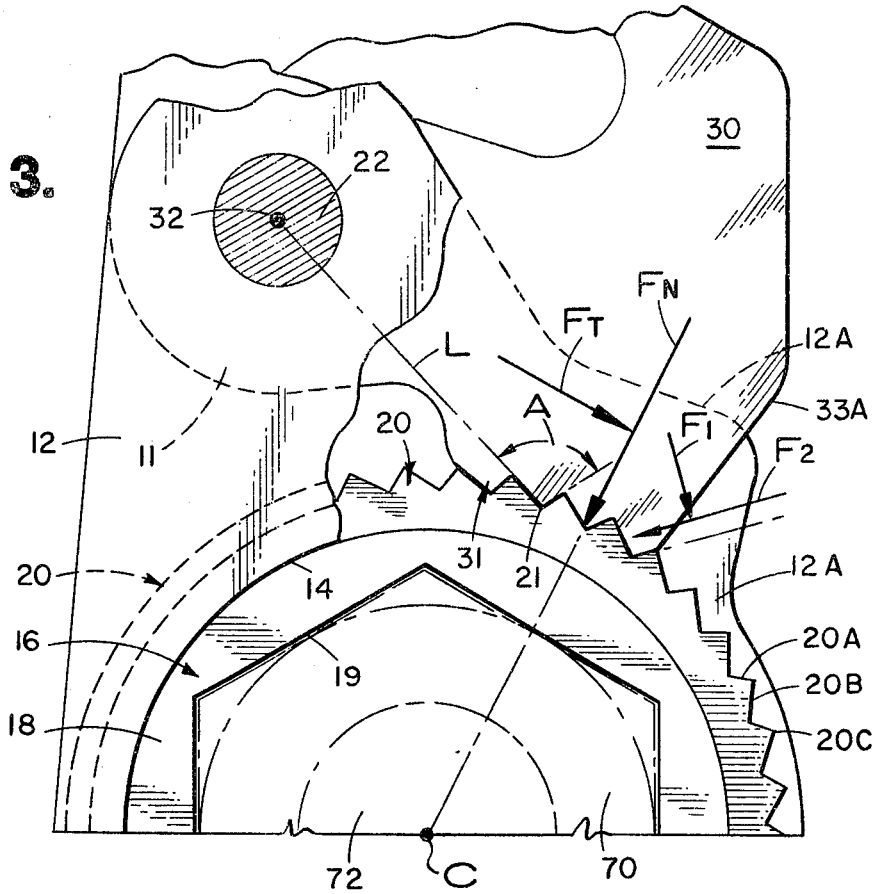
FIG. 4.
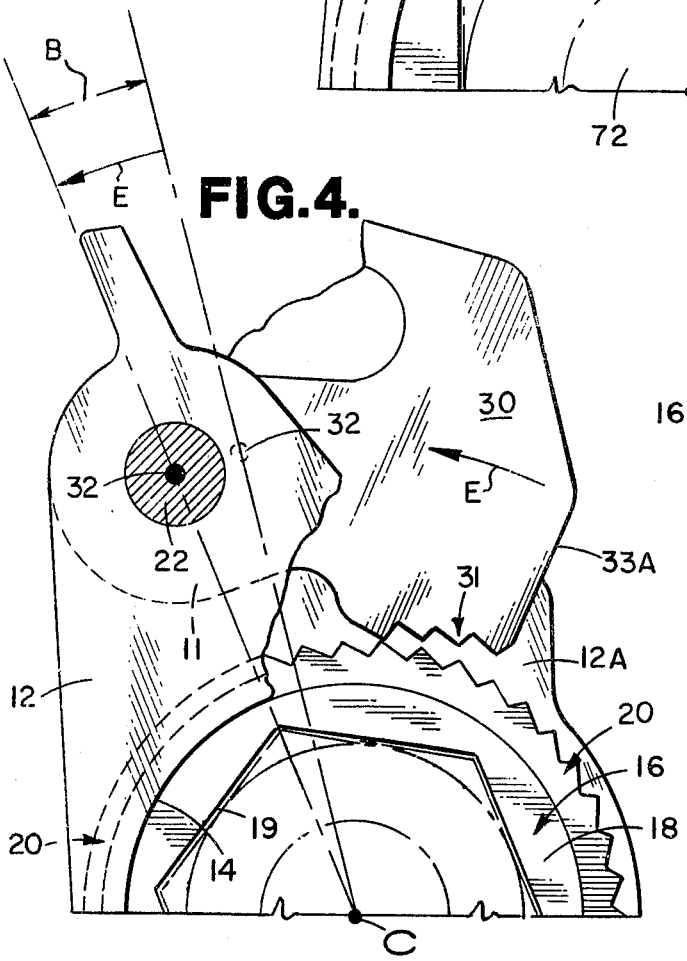
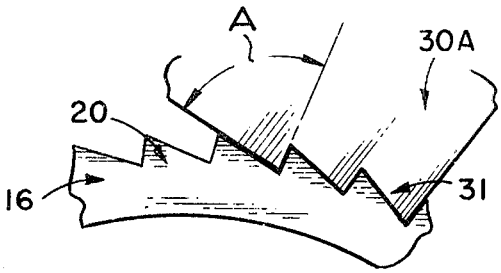
FIG. 5.
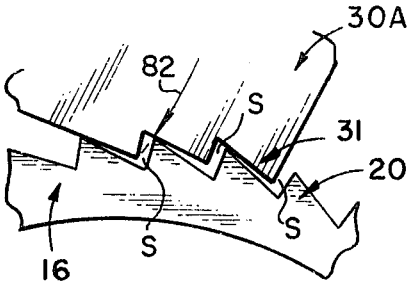
FIG. 6.

VERY HIGH TORQUE RATCHET WRENCH

CROSS REFERENCE TO RELATED APPLICATION

This application is a continuation-in-part of our U.S. patent application Ser. No. 619,116 filed Oct. 2, 1975, now abandoned.

BACKGROUND OF THE INVENTION

High-torque power wrenches, such as are described, for example, in U.S. Pat. No. 3,706,244, are now widely used on flanged connections. Each full swing of the power wrench is usually limited to an angular excursion ranging between 30° and 70°. A well-recognized drawback of such power wrenches is that, after each full swing, the wrench must be lifted from the threaded connector on the flanged connection and manually repositioned.

Ratchet wrenches for loosening or tightening nuts and bolts are well known, but they do not lend themselves for applications such as are described in said U.S. Pat. No. 3,706,244, because the torque applied to the housing of a conventional ratchet wrench produces both a substantial bending moment and a tensile force in the housing, which must be made sufficiently large and heavy to maintain its structural integrity.

But, the spacings between adjacent bolts on typical flanged connections, secured by high-torque bolts, are such that a large wrench housing would not fit in the available inter-bolt spacings. If the ratchet housing were to be elevated above the plane of the nuts or bolts, then it would become additionally subjected to eccentric loads, requiring the ratchet housing to be even larger in size and heavier.

It is a main object of the present invention to overcome the above mentioned and other well-known drawbacks of conventional ratchet wrenches, and to provide a new and improved high-torque ratchet wrench which can be made sufficiently small so that it can be used on flanged connections with closely spaced bolts.

SUMMARY OF THE INVENTION

The high-torque ratchet wrench of this invention comprises two parallel side plates. Each plate has at one end thereof a bore. An annular ratchet wheel and a cooperating pawl are operatively disposed between the plates. The ratchet wheel has a socket positionable over a threaded member for transmitting torque thereto. The ratchet wheel carries a plurality of angularly-spaced driven teeth. A hub laterally extends from each side of the wheel. The hubs are rotatably mounted in the bores of the plates. The pawl has a head end portion which is pivotable about a pivot pin providing a pivot axis. The pivot pin including the pivot axis transversely extends between the plates for pivotally mounting the pawl on the plates. A pawl arm extends outwardly of the pivot pin relative to the wheel. A pawl segment extends laterally and from the free end of the pawl arm relative to the wheel. The pawl segment has teeth adapted to mesh with the ratchet wheel teeth. The pawl segment is adapted to receive from the pawl arm a radial force, which urges the pawl segment teeth to engage with the ratchet wheel teeth, and a tangential force which rotates the ratchet wheel.

In a preferred embodiment, spring means couple the pawl arm to the side plates, thereby urging the pawl segment toward the ratchet wheel. Desirably, the bottom portion of each side plate around each ratchet wheel hub has a partial annular segment whose outer diameter is substantially equal to or less than the outer diameter of the toothed ratchet wheel. Desirably also, the angle between a root line, extending from the pivot pin's axis to the root, and the tooth face of any engaged ratchet wheel tooth is greater than 90°. A reciprocating ram is detachably coupled to the pawl arm for transmitting a push force and a pull force thereto. The transmitted push force produces the radial and tangential forces. The push force also produces reaction forces in the annular segments of the side plates which are almost in pure tension. Preferably, the number of teeth on the pawl's segment is at least four, and the number of teeth on the ratchet wheel is at least 20.

BRIEF DESCRIPTION OF THE DRAWINGS

FIGS. 3 and 4 are fragmentary enlarged plan views of a portion of the wrench shown in FIG. 1, illustrating the forces and movements involved; and FIGS. 5 and 6 show an entrapping or oblique tooth pattern.

DESCRIPTION OF A PREFERRED EMBODIMENT

Figure 2:
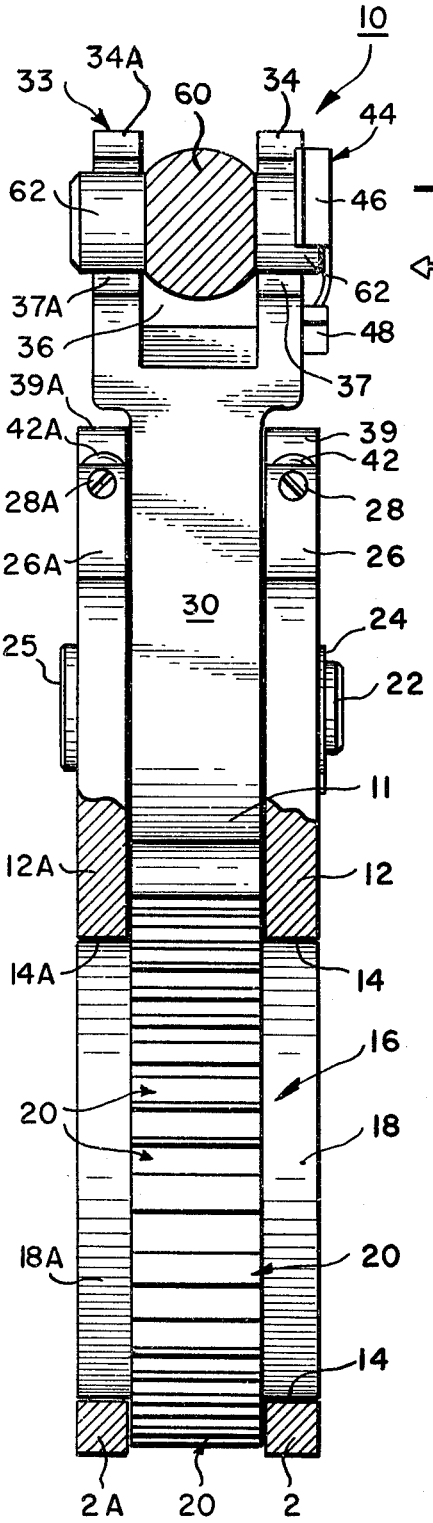
FIG. 2 is a view, partly in section, on line 2—2 in FIG. 1.
Figure 1:
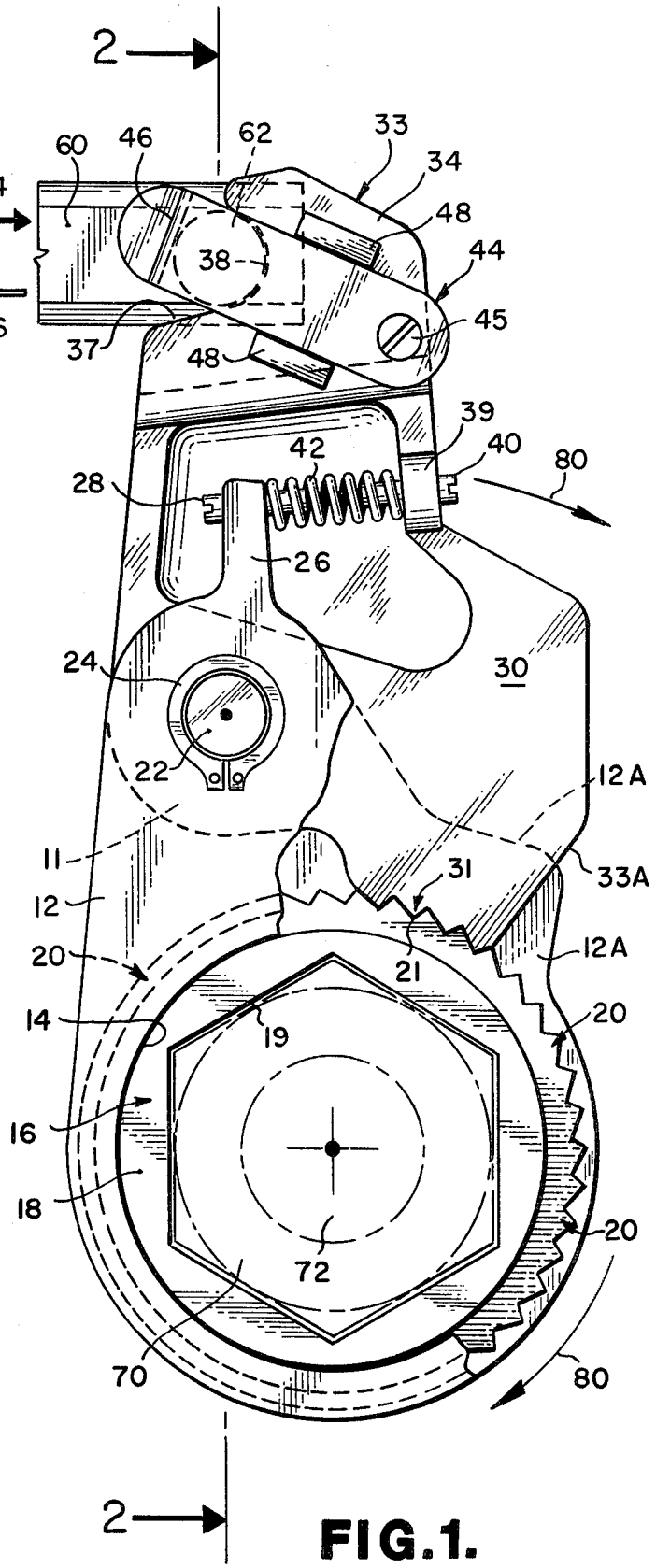
FIG. 1 is a plan view, partly in section, of the ratchet wrench of this invention.

Referring to FIGS. 1 through 3, the high-torque ratchet wrench of this invention, generally designated as 10, comprises two spaced-apart parallel side plates 12, 12A, whose end portions have partial annular segments 2, 2A defining cylindrical bores 14, 14A, respectively. A ratchet wheel 16 and a cooperating pawl 30 are operatively disposed between the plates. The cylindrical walls of bores 14, 14A rotatably support the side hubs 18, 18A, respectively, of the ratchet wheel 16 having on its outer cylindrical wall identical teeth 20. Each tooth 20 has a root 21, a front face 20A, a crest 20C, and a rear face 20B.

Wheel 16 can be adapted to transmit a torque to various members, but is herein illustrated as having an inner socket 19 adapted to receive therein a threaded member, such as a nut 70 on a bolt 72. The outer cylindrical surfaces of annular segments 2, 2A preferably have an outer diameter which is nearly equal to or less than the outer diameter of the toothed wheel 16. Minimum plate dimensions can be obtained for a wrench 10 which must operate on a typical flanged connection having critical inter-bolt gaps adjacent to the threaded member being rotated.

Pawl 30 has a head 11 which is pivotable on or about a pivot pin 22 having a pivot axis 32. The pivot pin's outer ends are secured to plates 12, 12A by a head 25 and a snap ring 24. Pivot pin 22 pivotally mounts pawl 30 on plates 12, 12A about pivot axis 32. A split pawl arm 33 extends from pivot pin 22 opposite to the main portion of the pawl arm which carries a pawl segment 33A laterally extending from the free end of the pawl arm, as shown. A substantially perpendicular push force, represented by arrow 64, or a substantially perpendicular pull force, represented by arrow 66, can be exerted against pawl arm 33. These forces are produced by a suitably-anchored hydraulic cylinder (not shown) on a reciprocating ram 60. Such a suitably-anchored hydraulic cylinder is shown in applicant's U.S. Pat. No. 3,706,244. Pawl arm 33 is preferably detachably coupled to ram 60, which fits inside a channel 36 between spaced parallel side walls 34, 34A on pawl arm 33. Walls 34, 34A, have concave recesses 37, 37A, respectively, each defining a bearing surface 38.

One end of a leaf spring 44 is secured by a screw 45 to side wall 34. A pair of tongues 48 hold spring 44 in a fixed angular position. The free end of spring 44 covers recess 37. A shoulder 46 projects inwardly from the free end of spring 44. Ram 60 carries a transverse pin 62 whose outer ends are rotatably supported by the bearing surfaces 38. Pin 62 is removably retained by shoulder 46 of resilient leaf spring 44.

A pair of lugs 39, 39A extend downwardly and outwardly from the opposite sides of pawl arm 33. A pair of lugs 26, 26A extend upwardly from side plates 12, 12A, respectively. Lugs 39, 39A carry screws 40, and lugs 26, 26A carry screws 28, 28A, respectively. A pair of coil springs 42, 42A are positioned between the two pairs of opposite lugs 26, 39 and 26A, 39A, respectively. Coil springs 42, 42A urge pawl segment 33A against ratchet wheel 16.

Pawl segment 33A has a plurality of teeth 31 which are adapted to match and mesh with teeth 20 of ratchet wheel 16.

In accordance with a very important aspect of this invention, at least the average angle A (FIGS. 3,4) between a root line L, extending from the pivot axis 32 to the root 21 of any engaged ratchet wheel tooth 20, and the front face 20A of such engaged tooth, is obtuse or non-entrapping, that is, greater than 90°. Such an obtuse tooth design pattern allows high torques to become transmitted at lower tooth stresses, as compared to an acute or entrapping tooth pattern (FIGS. 5,6). For very high-torque applications, the number of pawl teeth 31 simultaneously engaged with ratchet wheel teeth 20 should be at least four.

During the push stroke, a substantial perpendicular force component from ram 60 becomes exerted through pin 62 against pawl arm 33 in the direction of arrow 64. This force results in a radial force $F_N$ and in a tangential force $F_T$ which are transmitted through pawl segment 33A to ratchet wheel 16. Radial force $F_N$ is directed toward the center C of wheel 16 and force $F_T$ is perpendicular thereto. Force $F_N$ makes the the pawl's drive teeth 31 fall into and firmly engage the wheel teeth 20. The geometry of pawl 30 and the location of pivot axis 32 relative to pawl teeth 31 are such that forces $F_N$ and $F_T$, acting on and through the pawl segment 33A, can maintain the engagement between the pawl segment teeth 31 and the ratchet wheel teeth 20 when angle A is obtuse. This occurs because when angle A is greater than 90°, the resultant force, obtained from vectorially combining $F_T$ and $F_N$, is resolvable into a force component $F_1$ perpendicular to, and a force component $F_2$, parallel to the tooth face 20A. Force component $F_2$ is directed inwardly toward wheel 16 so as to ensure contact between teeth 20 and 31, while force component $F_T$ produces a torque sufficient to rotate ratchet wheel 16 during the push stroke of ram 60.

For each full push stroke of the hydraulically-operated ram 60, ratchet wheel 16 rotates a predetermined angular distance in the clockwise direction 80, thereby tightening nut 70 on bolt 72. Although springs 42, 42A are not needed for urging pawl segment 33A toward ratchet wheel 16, since the forces produced by springs 42, 42A are relatively small compared to the radial force $F_N$, nevertheless the springs are useful because the force of gravity, or friction between the side plates and the ratchet wheel, might cause teeth 31 to disengage from teeth 20 during repositioning of ram 60 for another power stroke.

The reaction forces developed by side plates 12, 12A to the push force provided by ram 60 appear almost entirely as tensile forces in the annular segments 2, 2A. Therefore, these annular segments can be made to have minimal cross-sectional dimensions, so as to allow wrench 10 to fit within the space limitations, imposed by critical inter-bolt spacings in many industrial flanged connections.

During the pull stroke of ram 60, a force is exerted on pawl arm 33 in the direction 66. Pin 62 is retained within channel 36 by the inwardly-projecting shoulder 46 of leaf spring 44. Ratchet wheel 16 is then stationary. Coil springs, 42, 42A couple plates 12, 12A to pawl 30, thereby permitting relative movement therebetween, such that lost motion or sliding of teeth 31 over stationary teeth 20 results.

FIGS. 3 and 4 show a non-entrapping tooth pattern wherein angle A is obtuse. At the end of the pull stroke, pivot axis 32 has rotated in a counterclockwise direction E (FIG. 4) through an angle B relative to the center C of ratchet wheel 16. As the plates 12, 12A rotate, teeth 31 ride up and disengage from teeth 20. When the crest of the first tooth 31 (closest to pivot 22) moves only slightly past the crest 20C of a mating tooth 20 in the direction E, the four teeth 31 will fall into and immediately fully engage four teeth 20 for transfer to the ratchet wheel 16 of a torque to be produced by the next push force 64.

FIGS. 5, 6 illustrate the lost motion produced for an entrapping the root pattern where tooth angle A is acute. Teeth 31 are then entrapped by teeth 20 and cannot disengage therefrom without first rotating pawl 30 in the direction E relative to center C until the crest of the first tooth 31 is well past the mating crest 20C of its mating tooth 20, at which time springs 42, 42A will cause the crest of the first tooth 31 to rotate clockwise along an arc 82 (FIG. 6). Upon the completion of this rotation, the front tooth faces 20A of the teeth 20 will be separated from their mating surfaces on teeth 31 by spaces S. These spaces increase the length of the required stroke by ram 60, as compared to a wrench 10 having a non-entrapping tooth pattern.

In conclusion, the production of the radial force $F_N$ and the use of a non-entrapping tooth pattern make the teeth less subject to adverse stress concentrations. The socket 19 of the ratchet wheel can therefore have a maximum opening which allows further weight and size reductions to be made in the wrench 10 of this invention and also allows the ratchet wheel to rotate directly on a maximum size nut. The tooth pattern of ratchet wheel 16 can now have an optimum configuration for maximum torque transfer, instead of having a configuration determined by the necessity for the ratchet wheel teeth 20 to entrap pawl teeth 31, so as to prevent disengagement therebetween.

Also, by simultaneously engaging at least four relatively small teeth 31 of pawl segment 33A with four teeth 20, a very-high torque can be transmitted by a short push stroke of ram 60. By using a number, say 20, of ratchet wheel teeth 20, thereby limiting the rotation of wrench 10 about ratchet center C to an angle of 18° per stroke, and by making ram 60 engage pawl arm 33 at a substantially right angle, the torque produced by the hydraulic cylinder on ram 60 can be fairly accurately measured by measuring only the applied pressure in the hydraulic cylinder, which is another important advantage of this invention. The greater the number of teeth 20, the more accurate the torque measurement will be. In FIG. 1, there are 42 teeth 20 giving an angle of rotation of about 8.5° per stroke.

When angle A is obtuse, the full push stroke of ram 60 is utilized to effect rotation of nut 70, and no portion of the stroke is wasted to compensate for lost spaces S (FIG. 6).

The above and other advantages will become readily apparent to those skilled in the art.

What is claimed is:

1. A high-torque ratchet tool, comrpising:

(1) a pair of parallel-spaced-apart side plates;

(2) a ratchet wheel mounted on for rotation between said plates, said wheel having a plurality of radially-extending driven teeth disposed about its outer periphery and defining a socket at the center thereof;

(3) a pawl member rotatably mounted about a pivot pin supported by and extending between said side plates, said pawl member having a pawl arm and a laterally-extending segment having a plurality of drive teeth matching and meshing with the driven teeth of said wheel, all of said drive teeth being spaced laterally from a line extending from the axis of said pivot pin to the axis of said wheel, and each angle (A), formed between a root line extending from the axis of said pivot pin to the root of each driven wheel tooth which is engaged by a pawl tooth and the front face of each such engaged wheel tooth, is greater than 90° ; and (4) spring means coupled between said pawl arm and at least one of said side plates for urging said drive teeth toward said driven teeth.

2. The ratchet tool of claim 1, and a nut positioned within said socket.

3. The ratchet tool of claim 1 and a bolt positioned within said socket.

4. The ratchet tool of claim 1, and a reciprocating ram means coupled to said pawl arm for producing radial forces and tangential forces which are transmitted through the pawl's drive teeth to said driven teeth, said radial forces when directed toward the center of said ratchet wheel making the drive teeth fall into and firmly engage with the driven teeth; and said radial forces when directed away from the center of said ratchet wheel causing the disengagement between the drive teeth and the driven teeth.

5. The ratchet tool of claim 4 and a nut positioned within said socket.

* * * * *